US009200858B2

(12) United States Patent
Bull

(10) Patent No.: US 9,200,858 B2
(45) Date of Patent: Dec. 1, 2015

(54) GUN REST FOR GAME BLIND

(71) Applicant: Brady D. Bull, Corpus Christi, TX (US)

(72) Inventor: Brady D. Bull, Corpus Christi, TX (US)

( * ) Notice: Subject to any disclaimer, the term of this patent is extended or adjusted under 35 U.S.C. 154(b) by 0 days.

(21) Appl. No.: 14/120,516

(22) Filed: May 28, 2014

(65) Prior Publication Data

US 2014/0352193 A1 Dec. 4, 2014

Related U.S. Application Data

(60) Provisional application No. 61/855,871, filed on May 28, 2013.

(51) Int. Cl.
*F41A 23/06* (2006.01)

(52) U.S. Cl.
CPC ..... *F41A 23/06* (2013.01)

(58) Field of Classification Search
CPC ..... F41A 23/00; F41A 23/18; F41A 23/16; F41A 27/00; F41A 23/02
USPC ..... 42/94; 89/37.01–37.09, 37.11–37.22
See application file for complete search history.

(56) References Cited

U.S. PATENT DOCUMENTS

| | | | | | |
|---|---|---|---|---|---|
| 1,324,934 | A | | 12/1919 | Shand | |
| 3,876,078 | A | * | 4/1975 | Gomes et al. | 211/64 |
| 4,937,965 | A | | 7/1990 | Narvaez | |
| 5,070,636 | A | * | 12/1991 | Mueller | 42/94 |
| 5,755,411 | A | | 5/1998 | Strong | |
| 5,778,589 | A | | 7/1998 | Teague | |
| 5,833,308 | A | | 11/1998 | Strong | |
| 5,964,435 | A | | 10/1999 | Peltier | |
| 5,979,099 | A | * | 11/1999 | Kervin | 42/94 |
| D440,625 | S | * | 4/2001 | Cook, Jr. | D22/108 |
| 6,526,687 | B1 | * | 3/2003 | Looney | 42/94 |
| 7,188,445 | B2 | | 3/2007 | Lehman | |
| 7,770,319 | B2 | | 8/2010 | McSonald | |
| 2006/0254114 | A1 | * | 11/2006 | Lehman | 42/94 |
| 2009/0126250 | A1 | | 5/2009 | Keng | |
| 2011/0101192 | A1 | * | 5/2011 | Lee et al. | 248/346.03 |
| 2011/0126444 | A1 | | 6/2011 | Keng | |
| 2012/0017485 | A1 | * | 1/2012 | Kern | 42/94 |

* cited by examiner

*Primary Examiner* — Joshua Freeman
(74) *Attorney, Agent, or Firm* — G. Turner Moller

(57) ABSTRACT

A gun rest includes a support assembly adapted to hook over a window sill and brace against a wall of a game blind. A universal joint on the support assembly provides a mount for a gun support to hold a long firearm. In one embodiment, the gun support includes spaced yokes to support, in a stable manner, a forestock and a stock butt enabling the hunter to look through a scope on the firearm without having to continuously grasp the firearm. In other embodiments, a single yoke, camera, spotting scope, binoculars or other device may be attached to the mount. In other embodiments, one or more of the yokes may be vertically adjustable and flexible straps may be affixed to one or more of the yokes to secure the weapon to the gun support.

20 Claims, 3 Drawing Sheets

GUN REST FOR GAME BLIND

This application is based, in part, on Provisional Application Ser. No. 61/855,871, filed May 28, 2013, priority of which is claimed.

This invention relates to an improved gun rest for a game blind in which the rest is supported on a window sill.

BACKGROUND OF THE INVENTION

A common hunting location is inside a game blind where the hunter is partly protected from the elements and is partly hidden from game. In many areas, the game are deer and the blinds are known as deer blinds. In such situations, the hunter sits on a chair or stool with a rifle sticking out of the blind through a window or similar opening. Much of the time, hunting is tedious in the sense of nothing happening so the hunter has to support the firearm on the window sill. If the hunter is using a scope on the rifle to look for game at a distance, the hunter may have to hold the weapon for extended periods and be more-or-less motionless.

There are gun rests proposed for use in game blinds such as shown in U.S. Pat. Nos. 5,778,589; 5,964,435 and 7,188,445. Other disclosures of interest are found in U.S. Pat. Nos. 1,324,934; 4,937,965; 5,755,411 and 5,833,308 and U.S. Printed Patent Applications 20100126444 and 20130232844.

SUMMARY OF THE INVENTION

A gun rest is provided for use in a game blind and may be supported on the sill of a window. The gun rest may include three major components, an assembly supporting the gun rest on the window sill, a yoke or other support for a long gun and a universal joint mounted on the assembly and connecting the yoke to the support assembly thereby allowing vertical, inclined and horizontal movement of the gun support. In some embodiments, the gun support may include a rigid beam having a pair of upwardly opening yokes allowing a long gun to be supported on the gun rest independently of the hunter whereby the hunter can simply look through a scope without having to support the weapon.

In some embodiments, an arm rest may be provided on the beam to support the trigger arm of the hunter. The arm rest may preferably be designed to accommodate left and right handed hunters.

It is an object of this invention to provide an improved gun rest for use in game blinds.

Another object of this invention is to provide a gun rest which may be supported on a window sill of a game blind and which is capable of supporting a rifle independent of the hunter.

A further object of this invention is to provide an improved gun rest which incorporates a universal joint allowing horizontal, inclined and vertical movement of a firearm and which provides a rigid arm rest suitable for left or right handed hunters.

These and other objects and advantage of this invention will become more fully apparent as this description proceeds, reference being made to the accompanying drawings.

DETAILED DESCRIPTION OF THE INVENTION

Figure 1:
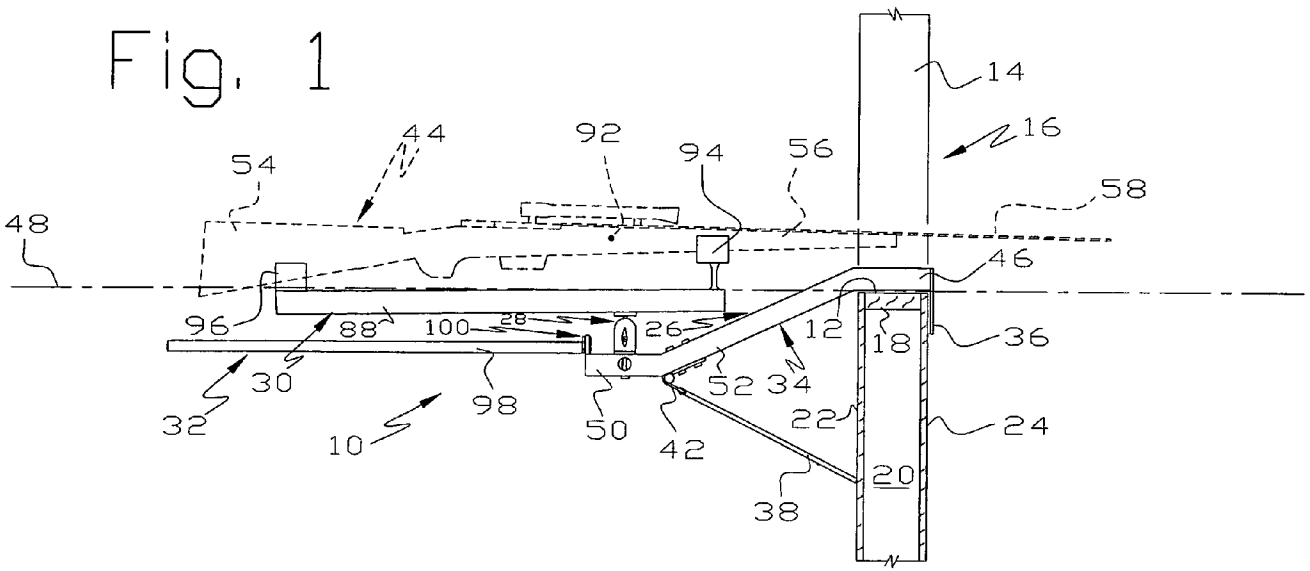
FIG. 1 is a side view illustrating a gun rest supported on a window sill and, in turn, supporting a rifle shown in dashed lines.

Referring to FIGS. 1-5, a gun rest 10 is illustrated as supported on a sill 12 of a window 14 comprising part of a game or deer blind 16. As is well know, the sill 12 is typically provided by a piece of lumber 18 which is supported from the base of the blind 16 by one or more verticals 20 which are typically sheathed on the interior or exterior by suitable panels 22, 24. The gun rest 10 may comprise, as major components, a support assembly 26 temporarily attaching the gun rest 10 to the sill 12, a universal joint 28, a gun support 30 and preferably an arm rest 32.

The support assembly 26 may comprise a beam 34 having one or more hooks 36 extending over the sill 12 and preventing movement of the gun rest 10 to the left in FIG. 1. The beam 34 may be metal, plastic, a composite material or the like and may be tubular or of an angle shape. The support assembly 26 may also include one or more braces 38 pivotally mounted to the beam 34 and connected by a folding strut 40. To this end, each brace 38 may be pivoted to the beam 34 by a hinge 42. The braces 38 prevent movement of the gun rest 10 to the right and down in FIG. 1. The support assembly 26 includes at least three points of contact with the game blind 16. As illustrated, the support assembly 26 includes one hook 36 and two braces 38 providing three points of contact with the blind 16 but may instead include two hooks and one brace. The support assembly 26 establishes a horizontal plane 48 which is generally perpendicular to the hook 36.

The beam 34 appears to be of ordinary construction but it includes several features that make the gun rest 10 desirable and effective by positioning the remaining components of the gun rest 10 in a position to support a long gun, shotgun or rifle 44 in a suitable position extending out of the blind 16. The beam 34 accordingly includes a first or front end 46 which typically rests on the sill 12 above the plane 48. The beam 34 includes a second or rear end 50 vertically below the front end 46 and below the plane 48 and an intermediate section 52 which may rigidly secure the front and rear ends 46, 50 into an integral piece. As shown in FIG. 1, the hinges 42 may conveniently be located at the junction of the intermediate section 52 and the rear beam end 50. One overall purpose of the end 50 being lower is to accommodate a relatively deep stock 54 of the rifle 44 compared to the forestock 56 so the barrel 58 is slightly depressed relative to the horizontal plane 48 because the sill 12 is typically substantially above ground level while the target is at ground level.

The universal joint 28 may conveniently be connected to the read end 50 of the beam 34 and provides the ability to shift the rifle 44 in horizontal, vertical and inclined directions. The universal joint 28 may be of any suitable type. A suitable device may be obtained commercially as a SLIK brand, Model #SBH-120 from Kenko Tokina Co. Ltd. SLIK of Toyko, Japan. Reference is made to publications of Kenko Tokina Co. Ltd. SLIK for a more complete description of the universal joint 28.

The universal joint 28 may include a base 60 which may be secured to the rear beam end 50, a housing 62, a ball 64 and a releasable connection 66 secured to the ball 64. The housing 62 may preferably be rotatable relative to the base 60 as suggested by the arrows 70 to accommodate both left and right handed hunters as pointed out more fully hereinafter. The housing 62 may preferably be vertically split by a groove 68 into segments 72, 74 and include a thumb screw 76 for squeezing the housing segments 72, 74 relative to the ball 64 for making the universal joint 28 more, or less, stiff.

The connection 66 may include an element 78 fixed to the ball 64 and extending upwardly out of the housing 62. The connection 66 also may include a platform connector 80 providing a square recess 82 to receive a similarly shaped plate 84 on the bottom of the gun support 30. A latch 86 may be pivotally secured to the connector 80 to captivate the plate 84 to the universal joint 28.

The gun support 30 may include a beam 88 of any suitable shape and material. Although the plate 84 may be connected to the beam 88 in any suitable manner, it is illustrated as connected by a threaded fastener 90 visible in FIGS. 1-3. It may be preferable that the plate 84 is vertically aligned, or nearly so, to the center of gravity 92 of the rifle 44 which easily balances the rifle 44 on the gun rest 10. The gun support 30 may include front and rear yokes 94, 96 receiving the forestock 56 and stock 54. The yokes 94, 96 may be made of any suitable material and include a crotch 97 for supporting the long gun 44. It will accordingly be seen that the forward yoke 94 is raised above the beam 88 so the gun rest 10 supports the rifle 44 in a sturdy position in the window sill 12 at a slight downward angle pointed toward the ground level expected target or game attractor without requiring any effort by the hunter.

The arm rest 32 may comprise a simple rigid tube or angle 98 pivotally connected to the beam 34, i.e. the arm rest 32 is rigid from a pivot connection 100 on one end of the arm rest 32 to the opposite free end of the arm rest 32. The pivot connection 100 may comprise a simple mating pin and sleeve, one being on the arm rest and the other being on the beam 34. The arm rest 32 may preferably be parallel or nearly so to the plane 48 and is of sufficiently width to be comfortable to a hunter. It will be seen from FIG. 3 that the arm rest 32 is pivotable between the left and right sides of the gun rest 10 to accommodate left and right handed hunters. It is usually convenient for a right handed hunter to adjust the stiffness of the universal joint 28 with the left hand and the opposite for a left handed hunter. This is accommodated by the housing 62 being rotatable relative to the base 60.

Figure 6:
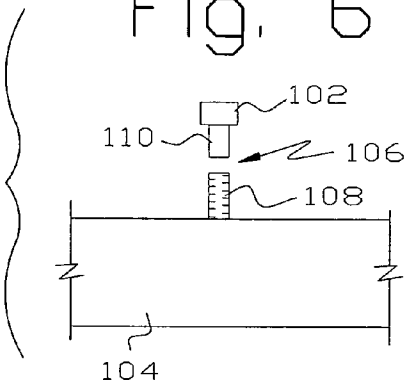
FIG. 6 is an exploded side view of another embodiment of this invention.
Figure 2:
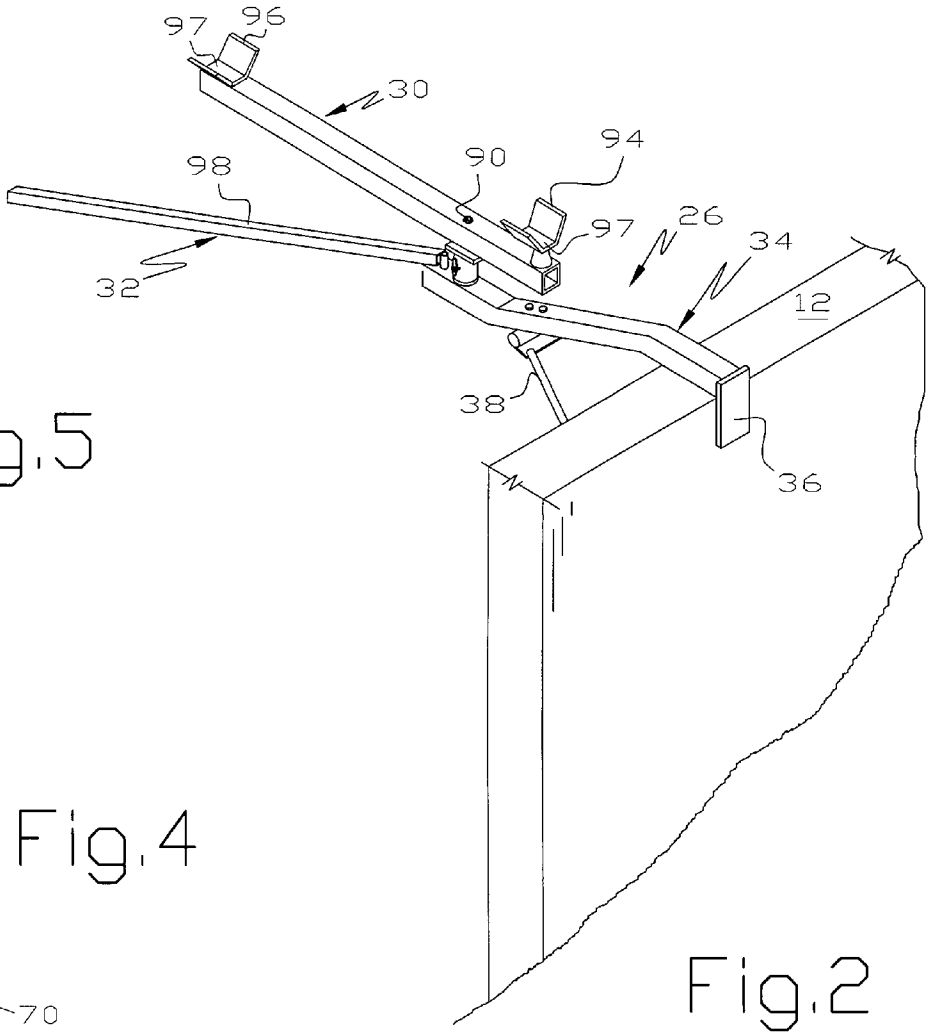
FIG. 2 is an isometric view, similar to FIG. 1, but without the firearm.
Figure 5:
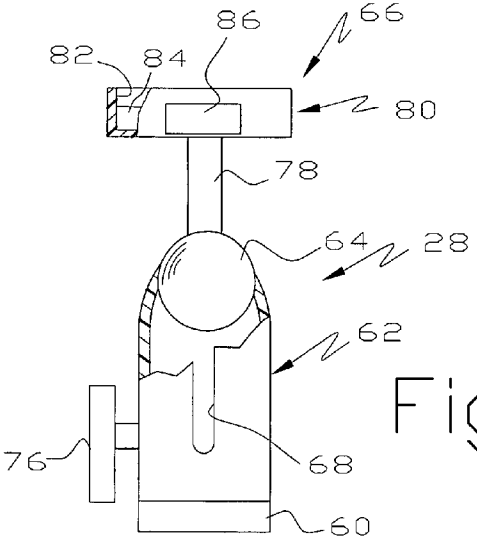
FIG. 5 is an enlarged side view of the universal joint of FIG. 4, certain parts being broken away for clarity of illustration.
Figure 4:
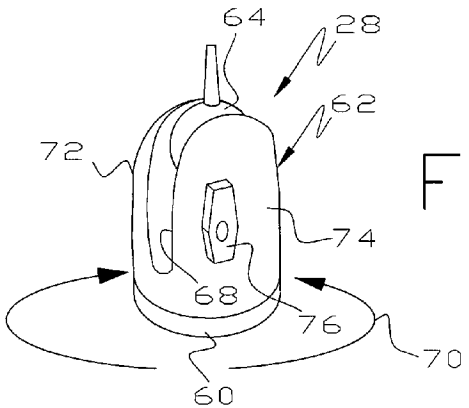
FIG. 4 is an isometric view of a universal joint comprising part of the gun rest of FIGS. 1-3.
Figure 3:
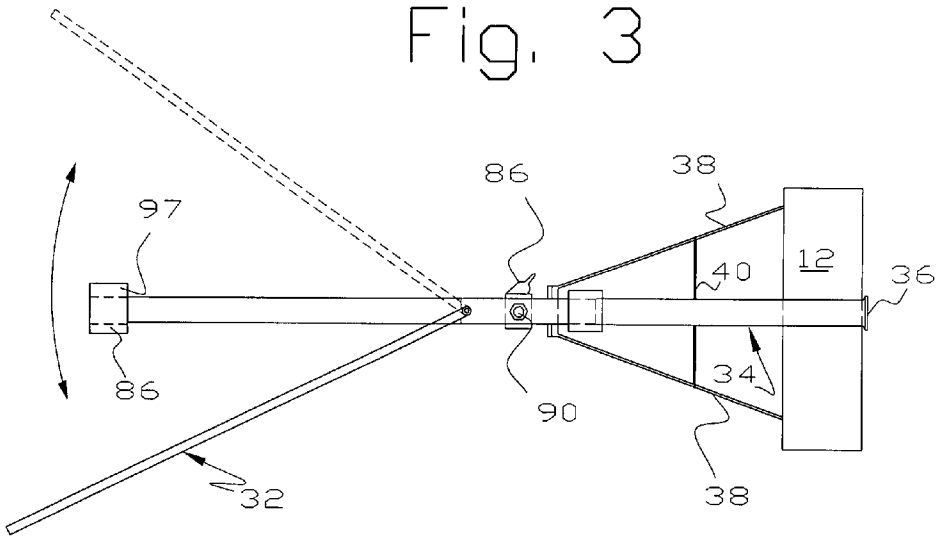
FIG. 3 is a top view of the gun rest of FIG. 1-2.

The height of the yokes 94, 96 in the embodiment of FIGS. 1-5 is a function of many factors including the height of the sill 12 in the game blind 16 relative to the expected target, the distance from the game blind 16 to the target and the other dimensions of the gun rest 10. The height of the sill 12 and the distance to the expected target are, of course, unique to every situation and the dimensions of the gun rest 10 are a compromise between average expected conditions. By vertically adjusting one or more of the yokes 94, 96 in the gun rest 10, the gun rest may be adapted to any reasonable situation. To this end, there is illustrated in FIG. 6 another embodiment of a gun rest including a yoke 102 supported on a beam 104 by a vertically adjustable connection 106 to make the gun rest 10. The adjustable connection 106 may be of any suitable type and may include a threaded upstanding post 108 and an interiorly threaded sleeve 110 projecting from the bottom of the yoke 102.

Figure 7:
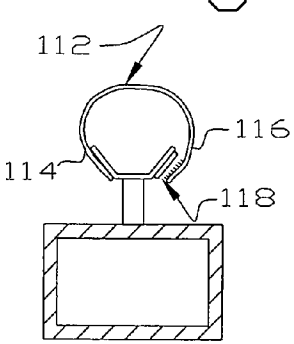
FIG. 7 is an end view of a yoke illustrating another embodiment of this invention.
Figure 8:
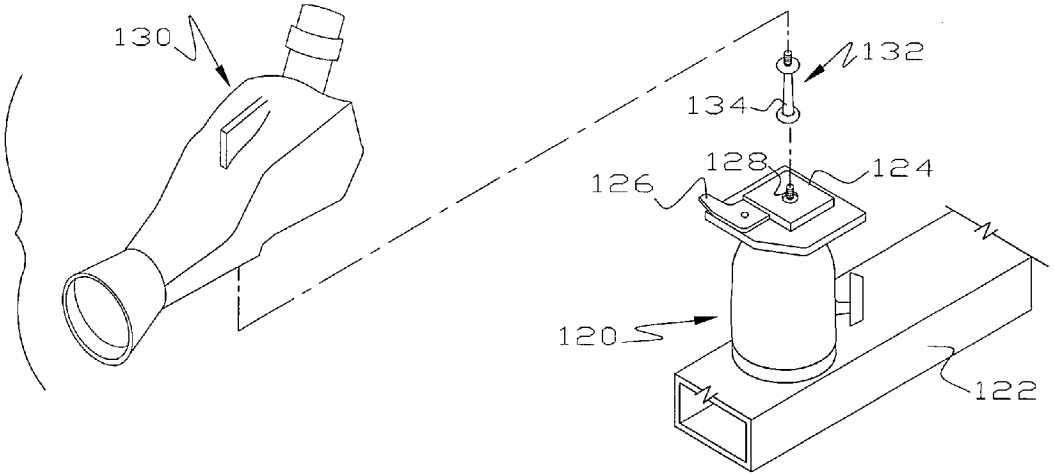
FIG. 8 is an isometric view of another embodiment of this invention.

Referring to FIG. 7, there is illustrated another embodiment of this invention where a flexible strap 112 is affixed to one or both of the yokes 94, 96. One end 114 of the strap 112 may be more-or-less permanently attached to one side of a yoke and the other end 116 provides a releasable connection to the opposite side of the yoke. Although any suitable releasable connection may be used, FIG. 7 illustrates a hook and loop connection 118. One purpose of the strap 112 is to secure the rifle 44 to the gun support 30 so the rifle 44 and gun support 30 may be detached from the universal joint 28 by releasing the latch 86. This allows the rifle 44 and gun support 30 to be carried in one hand and the FIG. 8 illustrates another embodiment of the invention where a universal joint 120 fixed to a beam 122 includes a platform connector 124 and latch 126 as in the embodiments of FIGS. 1-7. The platform connector 124 may include an upstanding threaded boss 128 to which an accessory 130 may be directly attached. In the alternative, an extension 132 may be provided to elevate the accessory 130 from the platform connector 124. The extension 132 may include a threaded sleeve 134 to receive the boss 128, an intermediate section 136 and a threaded end 138 to provide a connection compatible with the accessory 130. The accessory 130 may be of any suitable type, such as a camera, a spotting scope, binoculars or a single yoke for receiving a long gun.

Although this invention has been disclosed and described in one of its preferred forms with a certain degree of particularity, it is understood that the present disclosure of the preferred form is only by way of example and that numerous changes in the details of operation and in the combination and arrangement of parts may be resorted to without departing from the spirit and scope of the invention.

I claim:

1. A gun rest for use in a game blind comprising a support assembly including a first beam having a first beam end having at least one hook thereon adapted to hook over an opening and at least one brace pivoted to the first beam for abutting a wall below the opening, the first beam end and the hook configured to establish a plane adjacent an intersection of the hook and first beam end, the brace being on a first side of the plane, the hook and brace providing at least three spaced contact locations with the game blind, the first beam further comprising a second beam end on the first side of the plane, the second beam end being farther from the plane than the first beam end and positioning the first beam at an acute angle relative to the plane and an intermediate section connecting the first and second ends of the first beam, a universal joint supported on the second end of the first beam, and a second beam, mounted on the universal joint, having first and second upwardly opening yokes to support a long gun independently of a user, the second beam being moveable in horizontal, inclined and vertical directions and thereby pointing the long gun in different directions, the first yoke being between the universal joint and the first end of the first beam, the second yoke being farther from the hook than the first yoke, the first yoke being on a second side of the plane opposite from the first side of the plane.

2. The gun rest of claim 1 wherein the universal joint comprises a ball joint having a ball, a split housing mounting the ball for universal movement and an adjustable threaded fastener, compressing the split housing against the ball for adjusting stiffness of the universal joint.

3. The gun rest of claim 2 wherein the universal joint comprises a base fixed to the first beam, the housing being rotatable about an axis from a first position where the threaded fastener is on one side of the first beam to a second position where the threaded fastener is on an opposite side of the first beam thereby allowing stiffening adjustment from either side of the housing.

4. The gun rest of claim 1 wherein the second beam being positioned so the plane intersects a base of the second yoke, a base of the first yoke being further from the plane than the base of the second yoke providing a support for the long gun downwardly inclined relative to the plane.

5. The gun rest of claim 1 further comprising an arm rest having a first end pivoted on the first beam and a second end free of attachments, the arm rest being rigid between the first and second ends and having a flat upper surface sufficiently wide to support a user's arm.

6. The gun rest of claim 5 wherein the arm rest is planar and defines an acute angle relative to the plane.

7. The gun rest of claim 5 wherein the arm rest is pivotal from a first position on one side of the first beam to a second position on an opposite side of the first beam.

8. The gun rest of claim 1 further comprising first and second connectors securing the first and second yokes to the second beam, at least one of the connectors being vertically adjustable to adjust the angle of the long gun relative to the plane.

9. The gun rest of claim 1 further comprising a strap around at least one of the yokes having one fixed end and a second free end, the free end being securable to the at least one yoke for securing the long gun in the yoke.

10. The gun rest of claim 1 wherein the first beam is a rigid one piece element.

11. The gun rest of claim 1 wherein the second beam is on the first side of the plane.

12. A gun rest for use in a game blind comprising a support assembly including a beam having at least one hook on a first end of the beam adapted to hook over a sill of a window and at least one brace pivoted to the beam for abutting a wall below the sill, the first end of the beam and the hook being configured to provide a horizontal plane adjacent an intersection between the first beam end and the hook, the brace being below the plane on a first side thereof, the hook and brace providing at least three contact locations with the game blind, the first end of the beam providing a section configured to be supported on the window sill, the beam further comprising a second beam end on the first side of the horizontal plane farther from the plane than the first end of the beam, positioning the beam at an acute angle relative to the plane and thereby positioning the second beam end lower than the first end of the beam and an intermediate section connecting the first and second beam ends into a rigid one piece element; and a universal joint supported on the second beam end and a yoke support, mounted on the universal joint, for receiving a long gun to be moved in horizontal, inclined and vertical directions.

13. The gun rest of claim 12 wherein the universal joint comprises a ball joint having a ball, a split housing mounting the ball for universal movement and an adjustable threaded fastener compressing the split housing against the ball for adjusting stiffness of the universal joint.

14. The gun rest of claim 12 wherein the rearward yoke includes a crotch configured to support the long gun, the yoke support being positioned so the rearward yoke crotch being vertically closer to the first beam end than the second end of the beam.

15. The gun rest of claim 12 further comprising an arm rest having a first end pivoted on the beam and a second end free of attachments, the arm rest being rigid between the first and second ends and having a flat upper surface sufficiently wide to support a user's arm.

16. The gun rest of claim 15 wherein the arm rest is planar and is downwardly inclined relative to the yoke support.

17. The gun rest of claim 15 wherein the arm rest is pivotal from a first position on one side of the beam to a second position on an opposite side of the beam.

18. The gun rest of claim 12 further comprising first and second connectors securing the first and second yokes to the yoke support, at least one of the connectors being vertically adjustable to adjust the angle of the long gun.

19. The gun rest of claim 12 further comprising a strap around at least one of the yokes having one fixed end and a second free end, the free end being securable to the at least one yoke for securing the long gun in the yoke.

20. A rest for use in a game blind comprising a support assembly including a beam having at least one hook on a first end of the beam configured to hook over a sill of a window and at least one brace on the beam configured to abut a wall below the sill, the first beam end and the hook configured to establish a plane adjacent an intersection of the hook and first beam end, the brace being on a first side of the plane, the hook and brace providing at least three contact locations with the game blind, the beam further comprising a second beam end and an intermediate section connecting the first and second beam ends into a rigid one piece element, the second beam end being on the first side of the plane and farther from the plane than the first beam end positioning the beam at an acute angle relative to the plane; and a universal joint supported on the second beam end and a support, mounted on the universal joint, for receiving an article to be moved in horizontal, inclined and vertical directions;

an article on the support;

the support being closer to the plane than the second beam end and supporting the article above the beam.

* * * * *